United States Patent [19]

Vogel

[11] Patent Number: 4,589,204

[45] Date of Patent: May 20, 1986

[54] EATING UTENSIL

[75] Inventor: Allen J. Vogel, Schaumburg, Ill.

[73] Assignee: Courtesy Mold & Tool Corporation, Wheeling, Ill.

[21] Appl. No.: 674,029

[22] Filed: Nov. 21, 1984

[51] Int. Cl.[4] ..... A47G 21/04

[52] U.S. Cl. ..... 30/324; 30/340; 16/115

[58] Field of Search ..... 30/147, 150, 322, 328, 30/340; 16/115, 110 R, 150, 227, 225; 81/177 A; 24/489

[56] References Cited

U.S. PATENT DOCUMENTS

| | | | |
|---|---|---|---|
| 833,171 | 10/1906 | Von Munster | 30/147 X |
| 854,745 | 5/1907 | King | 30/150 |
| 1,372,325 | 3/1921 | Willemin | 30/147 X |
| 1,381,339 | 6/1921 | Rosen | 30/150 |
| 1,768,425 | 6/1930 | Smith | 30/322 |
| 3,418,681 | 12/1968 | Szabo | 16/115 |
| 3,447,195 | 6/1969 | Bush | 16/115 |
| 3,604,052 | 9/1971 | Bringer | 16/115 |
| 3,720,979 | 3/1973 | Krawagna | 16/150 |
| 4,027,714 | 6/1977 | Dixon | 16/225 |
| 4,060,176 | 11/1977 | Tobiasson | 30/328 |

*Primary Examiner*—Jimmy C. Peters

*Attorney, Agent, or Firm*—Allegretti, Newitt, Witcoff & McAndrews, Ltd.

[57] ABSTRACT

A collapsible eating utensil having food engaging means and integrally formed handle means. The food engaging means may be a knife, fork, or spoon. The handle means includes a rigid stem and segments adapted to be moved from folded position adjacent the stem to extended position in substantially longitudinal alignment with said stem. Locking means in the form of interengaging male and female members are provided on the segments to retain them in extended position.

9 Claims, 5 Drawing Figures

EATING UTENSIL

BACKGROUND OF THE INVENTION

This invention relates to an eating utensil, for example, a spoon, fork or knive, and more particularly to such utensil having collapsible handle means whereby the eating utensil is compact and may be packed within a carton for use.

A number of foods are sold in individual serving cartons. Various arrangements therefore are designed to include a spoon along with the carton when is it sold. Often a separate spoon such as one made from wood or plastic is provided. The spoon is usually larger than the diamter or height of the carton and adversely affects packaging of the cartons. If the spoon is very short, it is hard to use. If the spoon is not relatively flat, it could not stack easily. Also it is desired that the eating utensil be compact and stackable so that it may be readily shipped and stored. It is desired that there be provided an inexpensive, compact collapsible eating utensil having an extensible handle so that the eating utensil may be conveniently used.

The prior art includes some eating utensils which have components movable between a collapsed position and an extended position. Von Munster U.S. Pat. No. 833,171 shows pocket cutlery consisting of a knife, a spoon and a fork which are folded together. The parts are separately fabricated and connected together.

King U.S. Pat. No. 854,745 reveals a combined fork and spoon that are pivoted one upon the other.

Willemin U.S. Pat. No. 1,372,325 pertains to a folding knive, fork and spoon set wherein the parts are retained in extended position by a thumb screw.

Rosen U.S. Pat. No. 1,381,339 reveals a combined utensil including a fork and spoon that are pivoted one upon the other.

Smith U.S. Pat. No. 1,768,425 reveals a fork that is extensible away from and collapsible into a handle.

Tobiasson U.S. Pat. No. 4,060,176 shows a lid for a container that is convertible into a spoon.

None of the known prior art teaches a collapsible eating utensil integrally molded in one piece and incorporating a unique collapsible handle which is rigid and substantive in use and very compact for storage.

Therefore, it is an object of the present invention to provide a collapsible eating utensil wherein the deficiencies and disadvantages of known devices are obviated.

Another object of the present invention is to provide a collapsible eating utensil molded or formed in one piece from plastic, which utensil includes handle means adapted to be moved between a folded position and an extended position and to be retained in extended position by locking means comprising interengaging parts on the handle means. Other objects and disadvantages of the present invention will become more apparant hereinafter.

BRIEF DESCRIPTION OF THE DRAWING

Referring to the accompanying drawing, there is shown a preferred embodiment of the present invention wherein like numerals in the various views refer to like elements and wherein.

DETAILED DESCRIPTION OF THE PRESENT INVENTION

Figure 1:
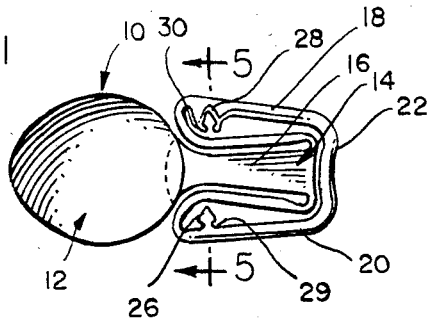
FIG. 1 is a plan view of a collapsible eating utensil, showing the handle means in the folded position.
Figure 2:
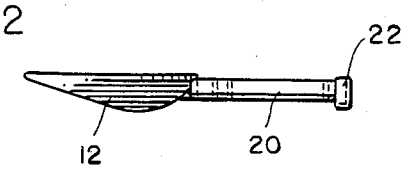
FIG. 2 is a side view of the collapsible eating utensil of FIG. 1.

There is shown in the drawing a presently preferred embodiment of a collapsible eating utensil 10 embodying the principles of the present invention. The collapsible eating utensil 10 comprises food engaging means 12 and integrally formed handle means 14. The food engaging means 12 may be a spoon, as shown, or alternatively, it might be a fork or a knife. The handle means 14 comprises a stem 16 secured to the food engaging means and spaced apart segments 18 and 20 integrally secured to the stem 16 at one end of each segment and adapted to be joined at the opposite end by an integrally formed loop closure 22. The segments 18 and 20 are adapted to lie to either side of the stem 16 when in the folded position as shown in FIGS. 1 and 2. The loop closure member 22 may be grasped and pulled outwardly from the stem to move the handle means 14 from the folded position shown in FIGS. 1 and 2 to the extended position shown in FIGS. 3 and 4.

Figure 3:
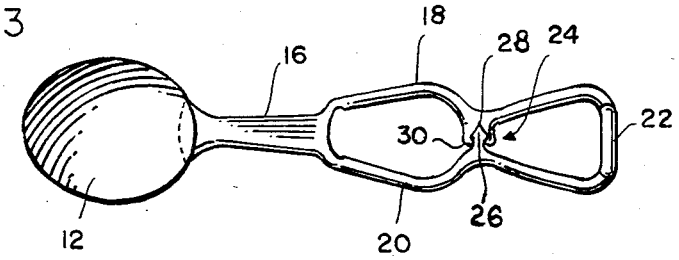
FIG. 3 is a plan view illustrating the collapsible eating utensil of the present invention, with the handle means in extended position.
Figure 4:
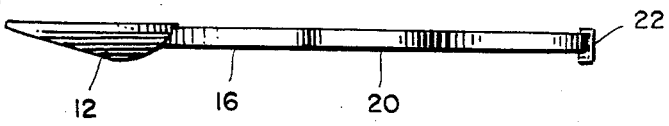
FIG. 4 is a side view of the collapsible eating utensil shown in FIG. 3.

Locking means 24 are provided to retain the segments 18 and 20 in extended position shown in FIGS. 3 and 4. Preferably, the locking means comprises a projection or male member 26 secured to segment 20 and a recess or female member 28 secured to the segment 18. The cooperating members 26 and 28 are arranged to face one another in the extended position of segments 18 and 20 such that when the projection 26 is aligned with the recess 28, the parts may be easily joined one to the other. The recess is formed with an indentation 30 at each side. The dimension between the indentations 30 is less than the maximum dimension of the projection 26, whereby when the head of the projection 26 moves past the indentations, the indentations 30 being resilient, will close behind the head of projection 26, engage in the recess 29 spaced from the free end of projection 26, and lock the members 26,28 together.

The loop closure 22, which is formed integrally with the segment 18 and 20, is thickened as best shown in FIGS. 2 and 4 to not only rigidify the segments 18 and 20 but also to facilitate gripping of the loop closure 22 by the fingers of the user. The structure enhances the ability of the user to readily move the handle means from the collapsed or folded position of FIGS. 1 and 2 to the extended position of FIGS. 3 and 4.

It will be understood that the stem 16 may be of different lengths depending upon the use application. For example, if the collapsible eating utensil is to be packed with an individual serving carton, it is desired that the utensil be placed within the lip defined by the cover of the carton. In such case, the eating utensil 10 would be formed so that the overall dimension thereof would be just slightly less than the internal diameter of the carton. Thus, it may be desirable to lengthen or shorten the stem 16 as desired for a particular use.

Figure 5:
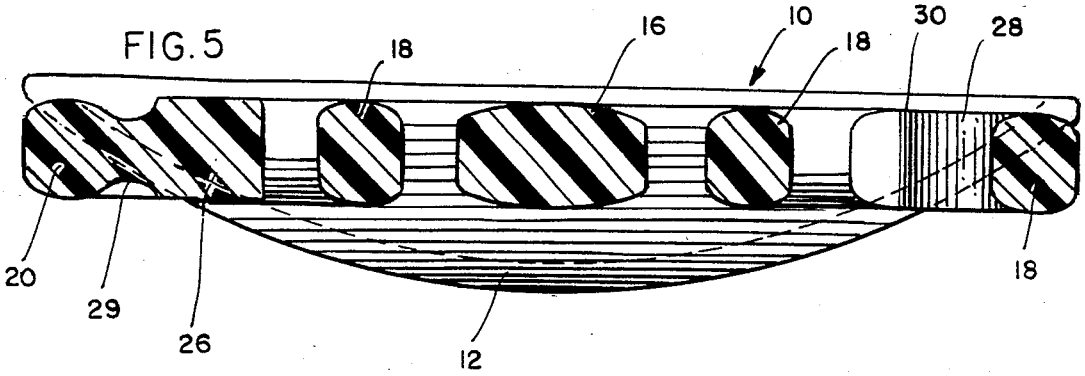
FIG. 5 is an enlarged transverse cross-sectional view of the collapsible eating utensil taken generally along the line 5—5 of FIG. 1.

Turning to FIG. 5, there is shown a cross section of the collapsible eating utensil 10. The projection 26 which is generally wedge shaped and has planar converging side walls, and flat parallel top and bottom walls, is integrally molded with the segment 20. The recess 28 is molded into a portion of the segment 18 of the eating utensil 10. The complementary projection 26 and recess 28 are formed intermediate the lengths of the segments 18, 20 and face one another. When the handle means 14 is moved to the extended position, the projection or male member 26 is aligned transversely with the recess or female member 28 and may be inserted into the recess or female member 28 and the parts locked together as explained above.

As seen in FIG. 2, the eating utensil 10 is substantially planar in the folded position. This will facilitate stacking a number of the utensils for packaging and/or shipment.

There has been provided by the present invention a collapsible eating utensil that is compact and that may be easily and inexpensively molded from plastic, for example, polypropylene. The eating utensil is molded in folded position as shown in FIG. 1 and is unitary. The utensil incorporates a handle means that will be moved from a folded position to extended position in substantial longitudinal alignment and includes locking means for retaining the handle means in the extended position.

While I have shown a presently preferred embodiment of the present invention, it will be understood that the invention may be otherwise formed within the scope of the appended claims.

What is claimed:

1. A collapsible eating utensil comprising food engaging means and integrally formed handle means joined with said food engaging means, said handle means comprising a stem secured to said food engaging means, means adapted to be moved from folded position adjacent said stem to extended position in substantially longitudinal alignment with said stem, and locking means for retaining the handle means in extended position, said extension means comprising spaced apart segments adapted to be folded upon one another adjacent the stem, said locking means comprising complementary interengaging means on the segments, said interengaging means comprising a male member on one segment adapted to engage within a female member on the other segment.

2. A collapsible eating utensil as in claim 1, wherein the food engaging means comprises a spoon.

3. A collapsible eating utensil as in claim 1, wherein the food engaging means comprises a knife.

4. A collapsible eating utensil as in claim 1, wherein the food engaging means comprises a fork.

5. A collapsible eating utensil as in claim 1 wherein the handle means are substantially planar in folded position to facilitate stacking of a number of said utensils.

6. A collapsible eating utensil as in claim 5 wherein there is a recess in the projection spaced from the face end thereof, and said indentations engage in said recess in the projection.

7. A collapsible eating utensil as in claim 1 wherein indentations are formed at the entrance to the female member to engage with the male member to help lock the male member and the female member together.

8. A collapsible eating utensil as in claim 1, which is formed in one piece.

9. A collapsible eating utensil as in claim 1 which is made from plastic formed in one piece.

* * * * *